US005755654A

United States Patent [19]

Schulz et al.

[11] Patent Number: 5,755,654

[45] Date of Patent: May 26, 1998

[54] METHOD AND APPARATUS FOR PINCH PERFORATING MULTIPLY WEB MATERIAL

[75] Inventors: Galyn Schulz, Greenville; Dale T. Gracyalny, Appleton, both of Wis.

[73] Assignee: James River Corporation of Virginia, Richmond, Va.

[21] Appl. No.: 547,233

[22] Filed: Oct. 24, 1995

[51] Int. Cl.[6] ..... B31B 1/50

[52] U.S. Cl. ..... 493/350; 83/678; 83/349; 83/345; 493/365; 493/390

[58] Field of Search ..... 493/344, 346, 493/350, 364, 365, 370, 390, 393; 83/678, 695, 349, 345

[56] References Cited

U.S. PATENT DOCUMENTS

| | | | |
|---|---|---|---|
| 3,256,131 | 6/1966 | Koch et al. . | |
| 3,510,380 | 5/1970 | Bittner et al. . | |
| 3,590,695 | 7/1971 | Gerard . | |
| 3,598,010 | 8/1971 | Chambon . | |
| 3,650,171 | 3/1972 | Reed | 83/349 |
| 3,795,163 | 3/1974 | Armstrong et al. . | |
| 4,108,097 | 8/1978 | Gross et al. | 83/349 |
| 4,334,449 | 6/1982 | Hinz et al. | 83/345 |
| 4,392,402 | 7/1983 | Rann | 83/345 |
| 4,409,870 | 10/1983 | Rynik et al. | 83/349 |
| 5,076,503 | 12/1991 | Cook | 83/349 |
| 5,114,771 | 5/1992 | Ogg et al. . | |
| 5,445,054 | 8/1995 | Pryor | 83/349 |
| 5,540,128 | 7/1996 | Creaden | 493/370 |

*Primary Examiner*—John Sipos
*Assistant Examiner*—John Paradiso
*Attorney, Agent, or Firm*—Sixbey, Friedman, Leedom & Ferguson, PC; Charles M. Leedom, Jr.; Donald R. Studebaker

[57] ABSTRACT

A method and apparatus for pinch perforating multi-ply web material to increase the perforation ply bond and/or perforation ply bond retention by pinching the multiple plies of web material together and then perforating the material using an anvil and perforator blade design provided on a perforating apparatus. Specifically, the apparatus comprises a roll mounted contoured perforator blade which cooperates with a beveled anvil to produce perforation ply bonds perpendicular to the length of the multiple plies of web material. The desired anvil/perforator blade interface angle between 0° and 20° is provided by beveling the anvil. A 15° beveled anvil is preferred to provide a 5° anvil/perforator blade interface angle. By pinching and bonding the leading edges and other predetermined points of the multi-ply tissue paper together before cutting, the likelihood of ply separation, missing plies and ply mismatch is greatly reduced.

20 Claims, 4 Drawing Sheets

FIG. 3
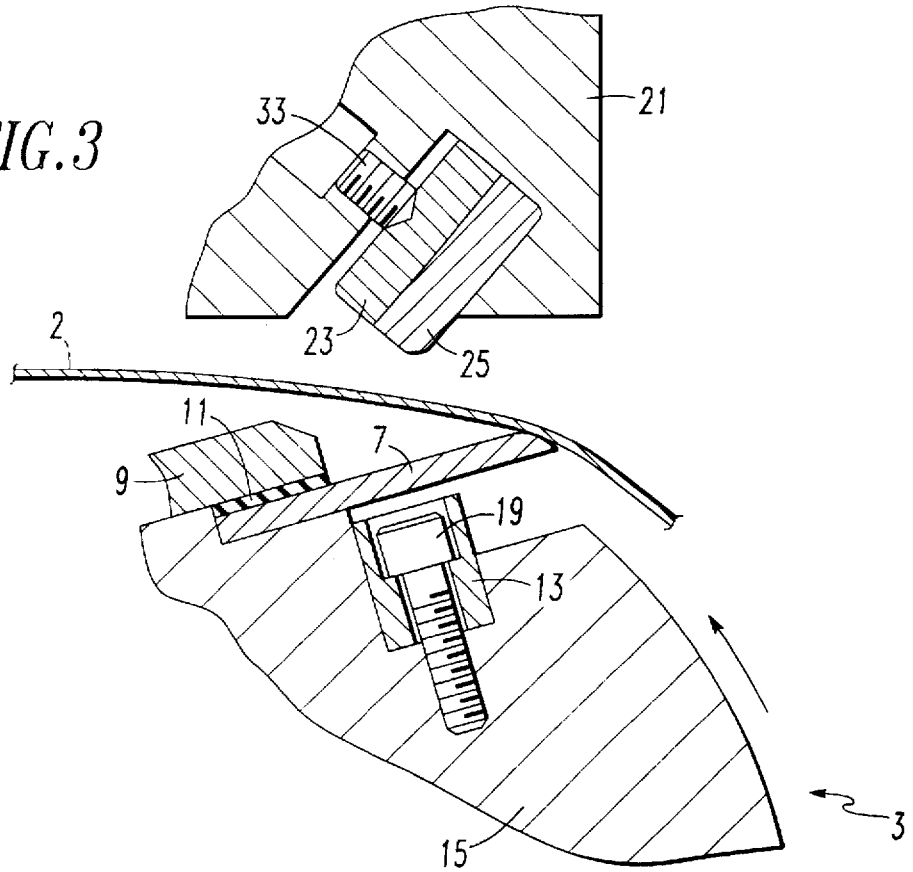
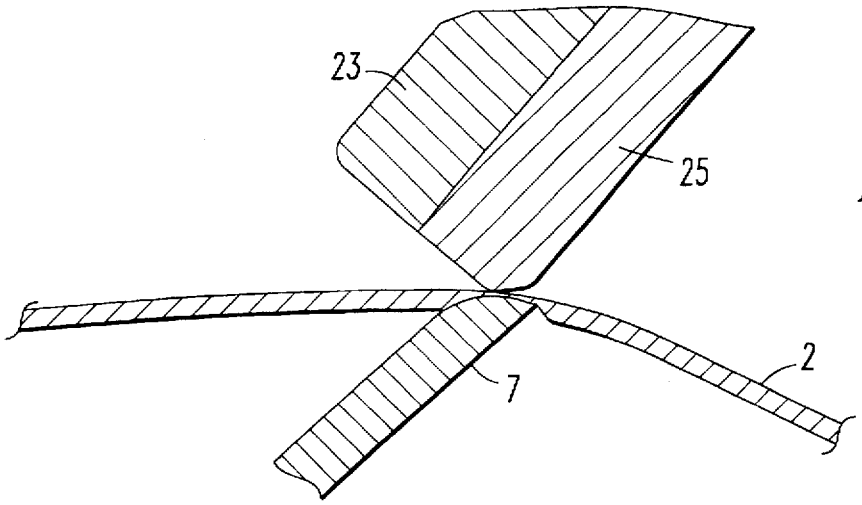
FIG. 4

METHOD AND APPARATUS FOR PINCH PERFORATING MULTIPLY WEB MATERIAL

TECHNICAL FIELD OF THE INVENTION

The present invention relates to the pinch perforating of paper products, and more specifically to an improved perforation blade and anvil design for pinching multiple paper plies together to avoid problems with ply separation, missing plies, ply mismatch and the like.

BACKGROUND OF THE INVENTION

Consumer paper products, such as toilet tissue and paper towels, are constantly being improved to enhance consumer satisfaction, customer loyalty, and product quality. As technology advances, more efforts are being made to simplify the process of making a multi-ply paper product, while at the same time improving the quality of the paper product by reducing the possibility of ply separation, missing plies, ply mismatch and other factors found to be undesirable by consumers.

Multi-ply paper products are typically made from two or more identical webs or sheets of paper which are bonded together and rolled onto a paper core. The webs may be bonded together using adhesives which can provide a strong bond between the multiple sheets. This manufacturing process, however, is costly and affects the pliability of the resulting multi-ply product which may cause consumer dissatisfaction in using the product.

When manufacturing a multi-ply paper product, such as toilet tissue, a perforation process is commonly used. In order for a consumer to use the toilet paper in an incremental fashion, the multi-ply sheets must be perforated in a manner which allows for easy dispensability. Thus, a consumer could detach and use one sheet or multiple sheets from the toilet tissue roll.

Conventionally, multi-ply paper products are perforated using a perforator blade and a complementary rigid anvil. The perforator blades are typically mounted on a rotating cylinder. The anvil is mounted opposite from the rotating cylinder and is positioned so that a multi-ply paper web can be perforated between the perforator blade and the anvil as the cylinder rotates. Normally, the perforator blade has teeth which cut through the thickness of the multi-ply web as it is held against the rigid anvil. These small cuts are perforations which define the individual sheets on the paper product roll. Depending on how the perforations are made, a consumer is able to dispense the individual paper sheets with difficulty or with relative ease.

The inventors have recognized particular problems associated with multi-ply paper products, such as toilet tissue, which effect consumer satisfaction. When a user dispenses one or more sheets from a toilet tissue roll, for example, the remaining leading sheet edge is usually frayed and the individual paper ply sheets are left unbonded. An unbonded leading edge may cause ply mismatch which occurs when a user attempts to dispense one or more sheets from the roll and ends up with more sheets from one of the multiply layers than from the other. For example, a user may attempt to dispense four even two-ply sheets from a tissue roll but end up with three top layer sheets and four bottom layer sheets. An unbonded leading edge can also result in ply separation and missing plies which may adversely affect consumer satisfaction with the paper product.

Many different methods and devices can be found in the prior art for cutting and perforating webbed material as discussed above. For example, U.S. Pat. Nos. 3,598,010 to Chambon and 3,795,163 to Armstrong et al. disclose devices and methods for employing perforator blades to perforate various webs and layers of material. The blades which are used in the above noted references, however, merely cut through the web material and do not provide a means to bond the leading edges of paper sheets to avoid ply separation, ply mismatch and missing plies.

Other blade designs are disclosed in U.S. Pat. Nos. 3,256,131 to Koch et al. and 3,510,380 to Bittner et al. These prior art references disclose rounded blade-like member mounted on a roll to bond multiple sheets of material. The blades used in these references, however, are designed for use with plastic and other synthetics materials, including foamed materials, which have different cutting requirements than paper webs. Moreover, a suitable method for bonding the leading edges of the multiple sheets of materials is not provided in either of the two prior art references. Thus, the apparatus and process disclosed in Koch et al. and Bittner et al. would not be appropriate for bonding two-ply paper material, such as toilet tissue, and would not provide a solution to the problem noted above.

In providing an adequate bond between each individual ply layer and each multi-ply tissue sheet, the perforation ply bond strength and the perforation tensile strength must be considered. The perforation ply bond strength is the strength of the bond between the multiple paper ply layers at the perforation zone. The perforation zone is the area where the tissue is bonded and perforated. The perforation tensile strength is the strength of the paper at the perforation zone after the sheet has been perforated. The level of perforation tensile strength should be optimized to enable high speed production of the multi-ply paper product but also enable the consumer to easily dispense the individual perforated sheets from the roll. Adequate perforation ply bond strength is necessary to ensure that the leading edges of the individual paper sheets remain bonded as individual sheets are removed from the paper roll.

Many methods have been used in the prior art to improve the perforation ply bond strength of a multi-ply web of material. For example, U.S. Pat. No. 5,114,771 to Ogg et al. discloses a perforator blade having alternatively spaced teeth and notches for optimizing both diametrically opposed properties of perforation tensile strength between adjacent paper sheets and perforation ply bond strength between superimposed plies. This reference concentrates on the relative size of the perforator blade teeth and notches to determine the appropriate perforation characteristics necessary to achieve both tensile and ply bond strength. The apparatus and method disclosed in this reference, however, simply cuts through the paper thickness to achieve the desired results and does not provide a method to adequately bond the leading edge of each individual tissue sheet.

U.S. Pat. No. 3,590,695 to Gerard discloses a system and procedure for joining together sheets of paper. A knife is used to bind the sheets together without the teeth of the knife blade penetrating through all of the laminated sheets. Although the Gerard reference discloses a technique for pinching multi-ply sheets together, the reference fails to disclose a method for bonding the leading edge of the each tissue sheet and perforating the multi-ply sheets after bonding.

In view of the existing prior art, as discussed above, there is a need for a cost effective manufacturing system and process that eliminates ply separation, ply mismatch, missing plies and the like by improving the perforation ply bond strength of the multi-ply paper product.

SUMMARY OF THE INVENTION

It is therefore an object of the present invention to provide an improved apparatus for manufacturing multi-ply paper products.

It is also an object of the present invention to provide an apparatus for pinching and perforating multi-ply paper sheets to yield individual multi-ply paper sheets which are bonded to one another at a perforation zone.

It is a further object of the present invention to provide an apparatus that bonds the leading edge of multiple paper plies to eliminate ply separation, missing plies, ply mismatch and the like.

It is another object of the present invention to provide an apparatus for bonding the leading edge of multiple paper plies such that one or more individual multi-ply paper sheets may be detached from a roll without separating the plies of the remaining leading edge.

It is yet another object of the present invention to provide an improved method for perforating multi-ply web material.

It is also an object of the present invention to provide a method for pinching multiple paper plies together to create a perforation ply bond before cutting through the paper ply thickness.

It is yet a further object of the present invention to provide a method for pinching and perforating the leading edge of multiple paper plies to eliminate ply separation, missing plies, ply mismatch and the like.

It is also an object of the present invention to provide a method for bonding the leading edge of multiple paper plies such that one or more individual multi-ply paper sheets may be detached from a roll without separating the plies of the remaining leading edge.

These and other objectives are achieved by a method and apparatus for pinch perforating multi-ply web material to increase the perforation ply bond and/or the perforation ply bond retention by pinching the multiple plies together using an anvil and perforator blade design. In the preferred embodiment of the present invention, the multi-ply sheets are pinched together to form a bond before the sheets are perforated. Specifically, the apparatus comprises a roll-mounted, contoured perforator blade which cooperates with a beveled anvil to bond multiple plies of tissue paper together without penetrating the tissue thickness. The anvil may be beveled with respect to the perforator blade to provide a desirable 0°–20° anvil/perforator blade interface. By pinching the multiple plies together at the perforation zones before cutting, the leading edge of each tissue sheet is bonded. As a user dispenses one or more sheets from the paper roll, the remaining leading edge of the paper sheet on the roll remains bonded together to eliminate undesirable ply separation, ply mismatch, missing plies or the like.

The present invention further provides a method and apparatus for increasing the perforation ply bond and perforation ply bond energy based on the perforator blade/anvil interface angle. In order to realize the optimal perforation ply bond, a 15° beveled anvil is employed to create a 5° blade/anvil interface angle. The use of a 15° beveled anvil with a contoured perforator blade increases significantly the perforation ply bond and perforation ply bond energy between the multiple paper plies.

A perforator blade having preferably from 30 to 120 contoured or rounded teeth, more preferably from 45 to 100 contoured or rounded teeth and most preferably from 54 to 81 contoured or rounded teeth to achieve the desired perforation ply bond strength and or perforation ply bond energy; however, one skilled in the art will appreciate that a perforator blade having more or less teeth may also be used to achieve the goals of the present invention.

BRIEF DESCRIPTION OF THE DRAWINGS

FIG. 3 is a cross-sectional, fragmentary view of the rotating perforator blade approaching the rigid anvil to perforate the multi-ply web material therebetween;

FIG. 4 is a cross-sectional, fragmentary view of the perforator blade pinching and perforating the multi-ply web material therebetween;

DETAILED DESCRIPTION OF THE PREFERRED EMBODIMENT

The present invention relates to an apparatus and method for pinch perforating multi-ply web material. In the preferred embodiment of the present invention, the perforating apparatus and method is used to manufacture two-ply toilet tissue. One skilled in the art should recognize, however, that the perforating apparatus and method discussed below could be used for bonding and perforating any multi-ply paper product.

Figure 1:
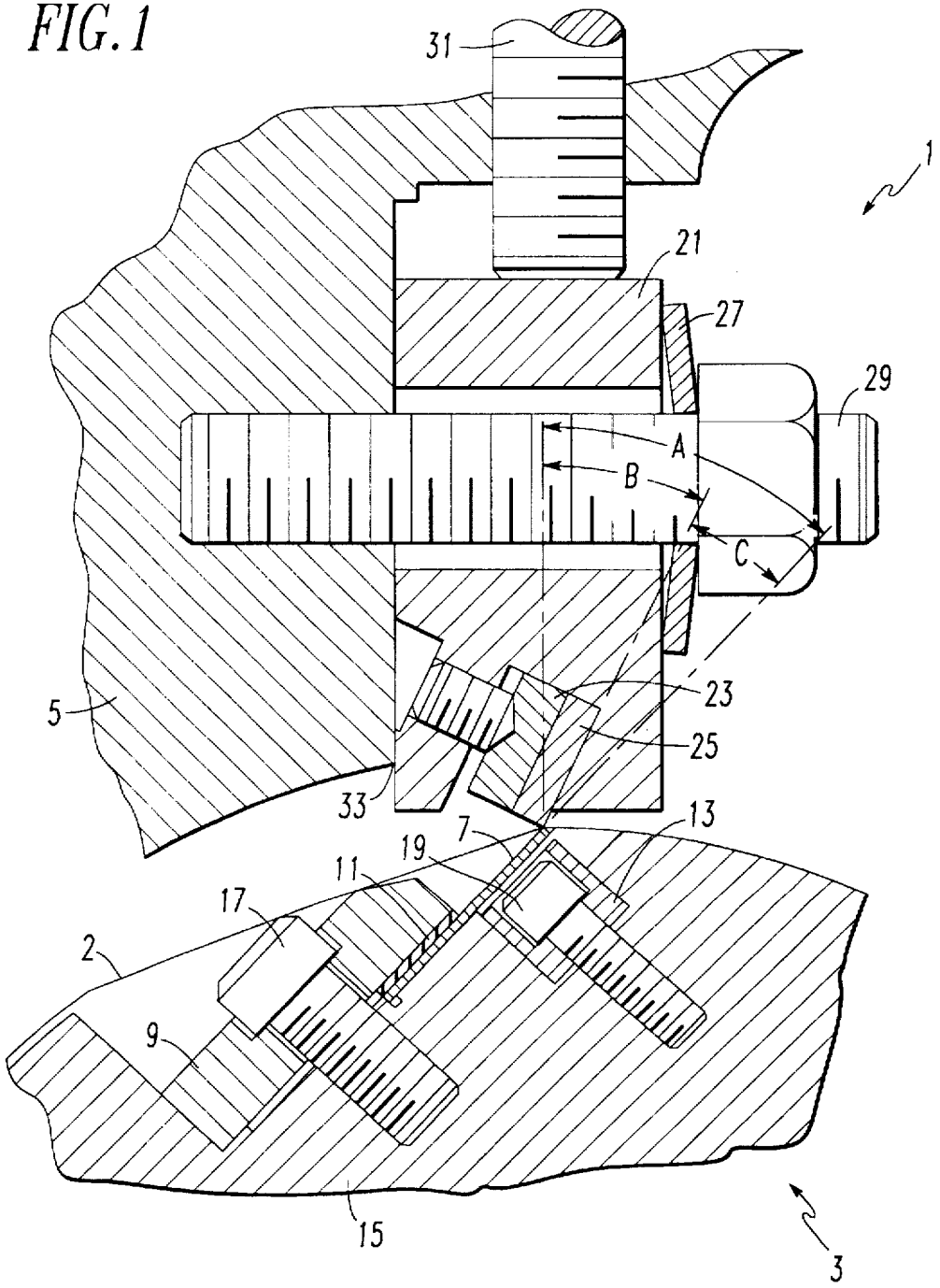
FIG. 1 is a cross-sectional, fragmentary view of the perforating apparatus in accordance with the preferred embodiment of the present invention.

FIG. 1 illustrates a fragmentary view of a perforating apparatus in accordance with the preferred embodiment of the present invention. The apparatus 1 comprises two separate components that are configured to cooperatively pinch and perforate multiple plies of web material 2. The two elements of apparatus 1 include a knife roll 3 and a stationary casting 5.

Figure 2A:
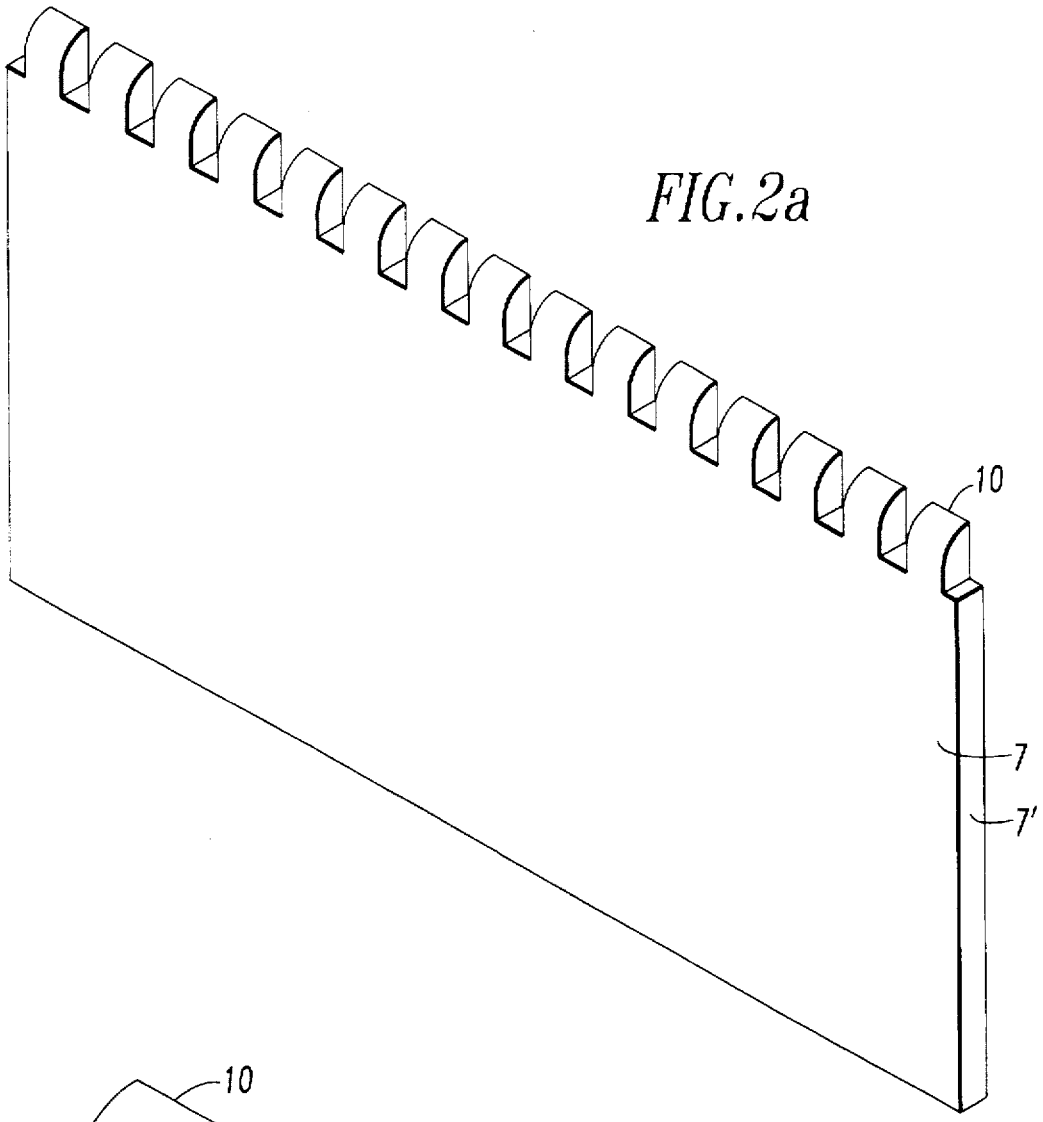
FIG. 2*a* is a perspective view of the perforator blade in accordance with the preferred embodiment of the present invention.
Figure 2B:
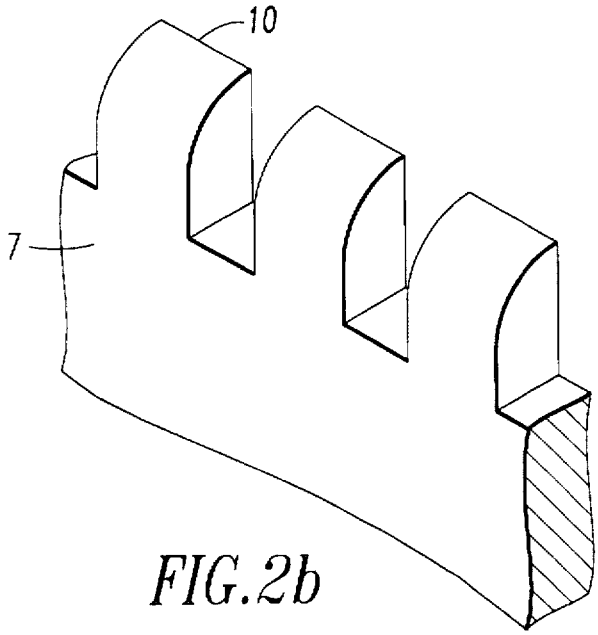
FIG. 2*b* is an enlarged, fragmentary, perspective view of the teeth of the perforator blade shown in FIG. 2*a;*

The knife roll 3 rotates counterclockwise about an axis and comprises a perforator blade 7, a perforator blade clamp 9, a gasket 11, a backing block 13, a bedroll 15 and bolts 17 and 19. The bedroll 15 makes up the body of the knife roll 3 and is a substantially cylindrical body composed of a rigid material such as steel. The perforator blade 7 is rigidly secured to bedroll 15 by perforator blade clamp 9 and has a series of teeth 10 which are rounded or contoured as shown in FIGS. 2*a* and 2*b*. The perforator blade clamp 9 is attached to bedroll 15 by bolt 17 which extends through the perforator blade clamp and into the bedroll. The perforator blade clamp is also made of a rigid material such as steel.

A gasket 11 is interposed between the perforator blade clamp 9 and the perforator blade 7 to equalize the pressure between the clamp 9 and blade 7. The perforator blade clamp 9 and gasket 11 apply pressure to the lower portion of the perforator blade 7, as shown in FIG. 1, so that the upper end of the perforator blade 7 remains free. The free end of perforator blade 7 is manufactured to deflect when engaging a complementary anvil 25 during the pinching and perforation process. A backing block 13 is provided to limit the amount of distance the perforator blade 7 can deflect. The backing block 13 is attached to the bedroll 15 by bolt 19 which extends through the backing block 13 and into the bedroll body.

The stationary casting 5 includes an anvil holder 21, a gib 23, an anvil 25, a cupped washer 27 and bolts 29, 31 and 33. The anvil holder 21 is rigidly attached to the stationary casting 5 by bolt 29 which extends therethrough. The cupped washer 27 is provided between the head of bolt 29 and the body of the anvil holder 21 to secure the position of the anvil while it is adjusted. The axial position of the anvil holder 21 with respect to the knife roll 3 is determined by bolt 31 which abuts the top surface of the anvil holder 21 as shown in FIG. 1.

The gib 23 and anvil 25 are provided in a bottom cavity of the anvil holder 21. The gib 23 is a block of rigid material which applies pressure to secure the anvil 25 against the cavity wall of the anvil holder 21. The anvil 25 is composed of tungsten carbide material in the preferred embodiment, however, other materials with similar characteristics may also be used. Moreover, the anvil may have rounded or square corners depending on the perforation characteristics desired. The gib 23 is secured in the cavity by a set screw 33 which extends through the body of the anvil holder 21 and slightly into gib 23 which applies pressure to anvil 25.

In FIG. 1, A represents the angle of the perforator blade held in the perforator bed roll, typically 45°. Angle B defines the position of the anvil face, typically 25°. Angle C is the blade/anvil interface angle, determined by the difference between the perforator blade angle A and the anvil position angle B. In a typical perforator apparatus, angle C is 20°. In the preferred embodiment of this invention, the blade/anvil interface angle C should be approximately 5° to yield the desired perforation ply bond strength, perforation ply bond retention, and perforation tensile strength of the multi-ply paper product. However, the blade/anvil interface angle C could be at any angle between 0° and 20°. A blade/anvil interface angle of 5° can be achieved by placing a 15° bevel on the carbide anvil 25. However, the 0° to 20° blade/anvil interface angle could also be achieved by any combination of perforator blade angle A, anvil position angle B, anvil bevel angle, or perforator blade bevel angle. For example, the anvil holder 21 could be redesigned to hold a non-beveled anvil to accommodate the desired blade/anvil interface angle. Any configuration or variation of the perforator apparatus used to achieve a 0° to 20° blade/anvil interface angle is covered in the scope of this invention.

FIG. 2*a* illustrates the perforator blade 7 in accordance with the preferred embodiment of the present invention. The perforator blade 7, as shown in FIG. 2*a*, is composed of a metal material such as steel that has rigid characteristics, however, maintains some flexibility. The perforator blade 7 is a thin structure that has a series of teeth 10 which extend the length of the perforator blade 7. The teeth 10, however, are not aligned with the side edges 7' of the perforator blade 7 structure so that the blades do not interfere with adjacent perforating blade structures during the manufacturing process. The teeth 10 on the perforator blade provide the pinching and perforating functions of apparatus 1. The number of teeth 10 on the perforator blade 7 directly correspond to the number of pinching or crimping bonds and perforations across the width of the multi-ply webbed material.

FIG. 2*b* shows an enlarged, fragmentary, perspective view of teeth 10 of the perforator blade 7 shown in FIG. 2*a*. This figure illustrates the contoured teeth of the perforator blade which are used to both pinch and perforate the multi-ply web material. The front face of the teeth are rounded to ensure that the teeth pinch the multi-ply paper sheets before cutting. The top edge of the teeth 10 are sharp and are used to cut through the multi-ply sheets. The gaps between the teeth 10 indicate the areas where the multi-ply tissue sheets are not ply bonded or perforated.

The thickness of the perforator blade 7 directly influences the perforation ply bond and tensile strength of the perforated paper product and thus, the perforator blade 7 thickness may vary according to the desired characteristics. In the preferred embodiment of the present invention, the perforator blade 7 thickness is between 0.040" and 0.047". The force of the perforator blade against the paper web material is proportional to the thickness of the perforator blade. Based on the static deflection, 0.047" thick perforator blades should deliver 1.6 times more force to the perforation zone than the 0.040" perforator blades.

The width of the teeth 10 and notches on the perforator blade vary with respect to the number of teeth. For example, each notch on a perforator blade having 54 teeth should be approximately 0.022" for a total notch width across the blade of 1.188". In an 81 tooth embodiment, each notch should be approximately 0.015" for a total notch width across the blade of 1.215". An 81-tooth perforator blade with a thickness of 0.040", a blade/anvil interference of 0.004", and used with an anvil beveled at 15° provides the greatest perforation ply bond strength based on the experimental results noted in Table 1 below.

A perforator blade having from 30 to 120 contoured or rounded teeth, more preferably from 45 to 100 contoured or rounded teeth may be provided. In the most preferred embodiment, it is desirable to have from 54 to 81 contoured or rounded teeth on the perforator blade 7 to achieve the desired perforation ply bond strength, perforation ply bond energy and tensile strength. The perforation ply bond strength is the bonding force between the plies of a multi-ply paper product. The perforation tensile strength is the strength of the multi-ply sheets at the perforation zone, shown in FIG. 5. One skilled in the art would appreciate that any number of teeth may be used on the perforator blade and thus, the present invention is not limited to 54 or 81 teeth. The number of teeth used determines the number of perforation ply bonds on the multi-ply paper product. Other factors which also influence the perforation ply bond and tensile strength include the perforation blade thickness, interference between the anvil and the perforator blade, and the bevel angle of the anvil used to achieve the desired blade/anvil interface angle. An example of the relationship between these factors and the perforation ply bond, perforation ply bond energy and the perforation tensile strength are provided in Table 1 illustrated below.

TABLE 1

| No. of BONDS | BLADE THICKNESS 0.001" | INTERFERENCE in | CARBIDE ANVIL BEVEL degrees | PERF PLY BOND g/4.5" | PERF PLY BOND ENERGY gm-in | PERF TENSILE g/3" |
|---|---|---|---|---|---|---|
| 54 | 40 | 0.004 | 0 | 21.0 | 1.41 | 418 |
| 54 | 40 | 0.004 | 15 | 26.3 | 1.71 | 446 |
| 54 | 40 | 0.008 | 0 | 27.9 | 1.96 | 381 |
| 54 | 40 | 0.008 | 15 | 28.2 | 2.20 | 404 |
| 54 | 47 | 0.004 | 0 | 25.4 | 1.49 | 452 |
| 54 | 47 | 0.004 | 15 | 28.3 | 1.63 | 444 |
| 54 | 47 | 0.008 | 0 | 26.7 | 1.61 | 419 |
| 54 | 47 | 0.008 | 15 | 26.9 | 1.70 | 448 |
| 81 | 40 | 0.004 | 0 | 28.3 | 1.84 | 529 |
| 81 | 40 | 0.004 | 15 | 33.2 | 2.35 | 535 |
| 81 | 40 | 0.008 | 0 | 24.8 | 1.79 | 435 |
| 81 | 40 | 0.008 | 15 | 28.6 | 1.81 | 472 |
| 81 | 47 | 0.004 | 0 | 25.9 | 1.39 | 518 |
| 81 | 47 | 0.004 | 15 | 27.5 | 1.68 | 506 |
| 81 | 47 | 0.008 | 0 | 25.7 | 1.46 | 456 |
| 81 | 47 | 0.008 | 15 | 24.1 | 1.47 | 466 |

It is evident from the data provided in Table 1 that a 15°-beveled anvil showed a statistically significant positive effect on the perforation ply bond and perforation ply bond energy. The perforation ply bond increased 25% and the perforation ply bond energy increased 21% when the 15°-beveled anvil, as opposed to a 0°-beveled anvil, was used with a 54-bond, 0.040" thick perforator blade at a 0.004" interference. A 34% increase in perforation ply bond was achieved when the 54-bond, 0.040" thick perforator blade was run with a 0.008" interference against a 15° beveled anvil. The perforation ply bond increased 58% and the perforation ply bond energy increased 67% when the 81-bond, 0.040" thick perforator blade was run with a 0.004" interference against a 15°-beveled anvil.

Figure 5:
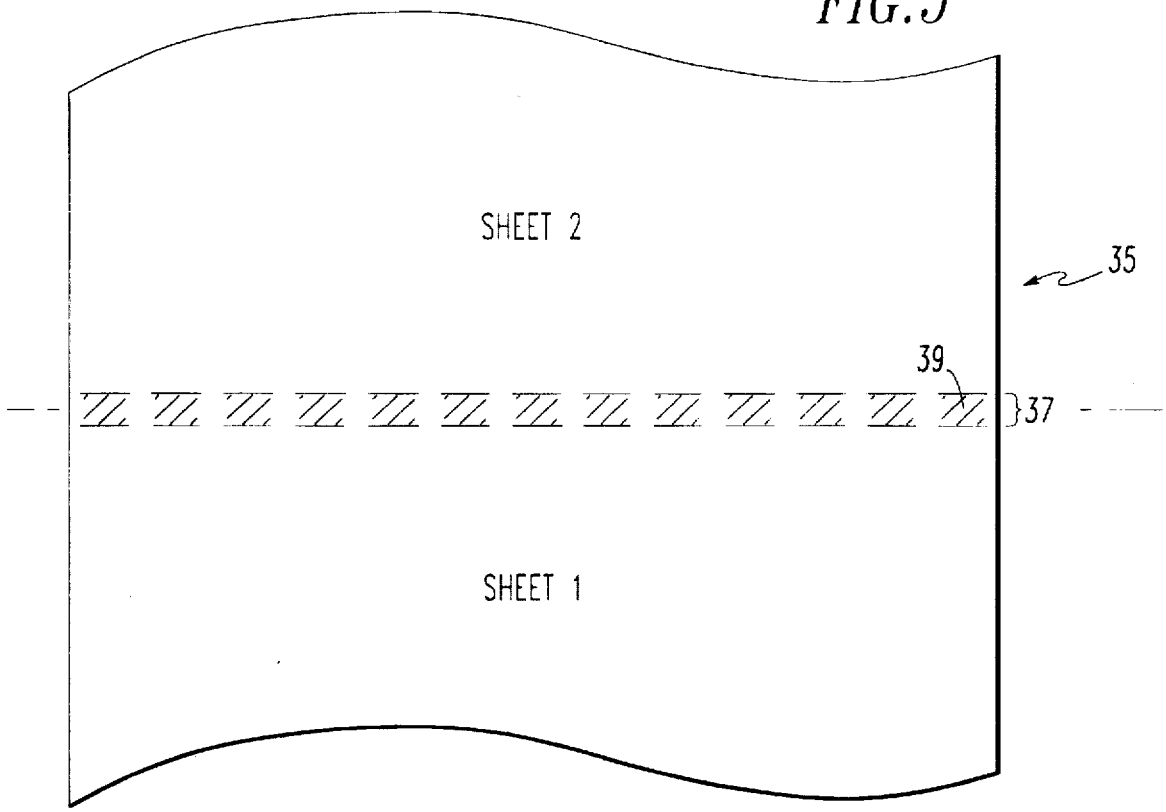
FIG. 5 is a fragmentary plan view of a paper product pinched and perforated by the perforator blades of FIG. 2*a* and 2*b*.

FIG. 3 illustrates the movement of the perforator blade 7 and knife roll 3 with respect to the anvil 25 and stationary casting 5. In operation, the anvil 25 and perforator blade 7 are positioned so that as the knife roll 3 rotates, there is a slight interference between the anvil 25 and perforator blade 7 to allow for the pinching and perforating of a webbed material provided therebetween. When manufacturing toilet tissue, multiple plies of webbed paper material 2 are fed between the anvil and perforator blade and are subsequently wound onto a paper roll. The perforator blade 7 approaches the anvil 25 in a counterclockwise motion, as shown in FIG. 3. As the paper passes between the anvil and perforator blade configuration the paper is first pinched between the rounded perforator blade teeth and the anvil, as shown in FIG. 4. After pinching the multiple paper plies together to form a perforation ply bond, the perforator blades cut perforations into the multi-ply sheets across the width of the paper web material to create individual tissue sheets connected at the perforation, as shown in FIG. 5. After the web material has been ply bonded and perforated, it is wound onto a paper roll, packaged and sold to consumers.

As the consumer unwinds the roll to use one or more paper sheets, the individual sheets are detached at the perforation and the leading edge of the end sheet remaining on the paper roll remains bonded together to eliminate the possibility of missing plies, ply mismatch, ply separation, and the like. Thus, product quality and consumer satisfaction are enhanced by using the present invention to manufacture multi-ply paper products.

FIG. 5 illustrates a fragmentary plan view of a paper product pinched and perforated by the perforator blades of FIG. 2*a* and 2*b*. The figure illustrates two individual toilet tissue sheets 35 which are separated by the perforation zone 37. The perforation zone comprises both the perforation ply bonds and the perforation cuts. The shaded areas 39 of sheet 2 represents the area of the web which is pinched by the perforator blade. When "sheet 1" is detached from "sheet 2", the shaded area at the leading edge of "sheet 2" remains bonded together. If the multiple layer and plies of the remaining sheet are left unbonded, the tissue plies may come loose or become separated when "sheet 1" is detached from "sheet 2" at the perforation zone 37. Moreover, when detaching "sheet 1", the top ply of "sheet 2" may also become detached resulting in a single ply sheet being left as the leading sheet on the paper roll. Furthermore, the plies of the leading sheets on the roll may become loosely separated if the multiple layered plies of "sheet 2" are left unbonded. All of these problems which occur when the leading edge of the tissue sheets are left unbonded result in undesirable appearance and/or dispensability to a consumer of the paper product. It also may effect consumer loyalty to the paper product, in that, the consumer may view the tissue product as being of lesser quality than a product which has a bonded leading edge. Thus, the present invention provides an effective solution, not shown or disclosed in the prior art, for eliminating the undesirable problems discussed above.

Figure 6:
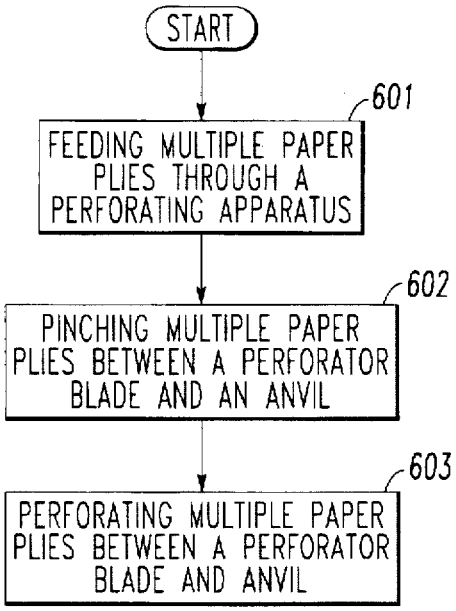
FIG. 6 is a flowchart illustrating the manufacturing process of pinching and perforating multi-ply web material in accordance with the preferred embodiment of the present invention.

FIG. 6 is a flowchart illustrating the manufacturing process of pinching and perforating multi-ply web material. The flowchart outlines the preferred method for perforating multiple paper plies using the perforator blade and anvil configuration discussed above with reference to FIG. 1. In step 601 multiple paper plies are fed between the perforator blade and the anvil as shown in FIG. 3. The perforator blade then pinches the multiple paper plies against the beveled anvil to create a desired perforation ply bond between the multiple plies, as shown in step 603. The multiple paper plies are then perforated by the perforator blade cutting through the tissue thickness against the anvil to provide a plurality of cuts in a direction perpendicular to the length of the multiple paper plies and creating a series of individual paper sheets connected at the plurality of cuts, as shown in step 605. This process bonds and perforates the leading edge of each individual tissue sheet to avoid ply separation, ply mismatch, missing plies and other similar undesirable characteristics.

Accordingly, as can be appreciated from the foregoing description, the present invention provides a cost effective manufacturing process and apparatus which eliminates ply separation, ply mismatch, missing plies and the like by improving the perforation ply bond strength of the multi-ply paper product.

While the invention has been described with reference to the preferred embodiment, it should be appreciated by those skilled in the art that the invention may be practiced otherwise than as specifically described herein without departing from the spirit and scope of the invention. It is therefore, understood that the spirit and scope of the invention be limited only by the appended claims.

What is claimed is:

1. An apparatus for bonding a leading edge of multiple paper plies, comprising:

a knife roll;

a perforator blade rigidly attached to said knife roll having a plurality of teeth, each tooth having a contoured leading face and a trailing cutting edge;

a stationary casting rigidly positioned adjacent to said knife roll; and an anvil rigidly attached to said stationary casting, wherein said perforator blade and said anvil cooperate to pinch the leading edge of said multiple paper plies together by said contoured leading face and perforate the multiple paper plies with said trailing cutting edge subsequent to said pinching.

2. The apparatus of claim 1 further comprising an anvil holder rigidly attached to said stationary casting, said anvil holder securing a gib and said anvil within a cavity in said anvil holder.

3. The apparatus of claim 1, wherein said knife roll further comprises a perforator blade clamp rigidly attached to said knife roll, said perforator blade clamp securing said perforator blade onto said knife roll.

4. The apparatus of claim 3, wherein a gasket is interposed between said perforator blade clamp and said perforator blade.

5. The apparatus of claim 1, wherein a planar surface of said anvil is between 0° and 20° with respect to a planer surface of said perforator blade.

6. The apparatus of claim 5, wherein a planar surface of said anvil is beveled 15°.

7. The apparatus of claim 1, wherein said knife roll includes an adjustable backing block positioned adjacent said perforator blade to limit the deflection of said perforator blade.

8. The apparatus of claim 1, wherein said anvil comprises rounded corners.

9. The apparatus of claim 1, wherein said perforator blade includes 30 to 120 teeth.

10. The apparatus of claim 9, wherein said perforator blade includes 54 to 81 teeth.

11. The apparatus of claim 1, wherein said perforator blade has a square leading face on each tooth.

12. A method of pinching and perforating multiple paper plies comprising the steps of:

feeding said multiple paper plies between a perforator blade and an anvil;

said perforator blade including a plurality of teeth, each tooth including a contoured leading face and a trailing cutting edge;

pinching a leading edge of said multiple paper plies between said contoured leading face of said perforator blade and said anvil to bond said multiple paper plies to one another; and perforating said multiple paper plies by said trailing cutting edge in a region adjacent the bond between the multiple paper plies to provide a plurality of cuts in a direction substantially perpendicular to the length of said multiple paper plies and create a series of individual paper sheets connected at said plurality of cuts, wherein a perforation ply bond between the multiple paper plies is created at the leading edge of each said individual sheet.

13. The method as defined in claim 12, wherein a planar surface of said anvil is between 0° and 20° with respect to a planer surface of said perforator blade.

14. The method of claim 13, wherein a planar surface of said anvil is beveled 15°.

15. The method as defined in claim 12, wherein said multi-ply paper plies form a tissue roll and said bond between said multiple paper plies is downstream from said plurality of cuts in a direction of removing sheets from said tissue roll.

16. A device for forming a plurality of multi-ply interconnected sheets comprising:

a feeding means for feeding a multi-ply web of indeterminate length; and a perforator blade including a plurality of teeth, each tooth including a contoured leading face constituting a pinching means for periodically pinching a predetermined portion of the multi-ply web to bond said portions together; and a trailing cutting edge constituting a perforating means for periodically perforating the multi-ply web in a region adjacent said bond and said predetermined portion of the multi-ply web.

17. The device as defined in claim 16, wherein said multi-ply paper plies form a tissue roll and said bond between said multiple paper plies is downstream from said plurality of cuts in a direction of removing sheets from said tissue roll.

18. The device as defined in claim 16, wherein said predetermined portion of the multi-ply web extends substantially transverse to a length of the multi-ply.

19. The device as defined in claim 18, wherein said predetermined portion of the multi-ply ply web includes a plurality of spaced regions.

20. The device as defined in claim 16, wherein said multi-ply web is a two-ply toilet tissue web.

* * * * *